US006488511B1

(12) United States Patent
Stewart

(10) Patent No.: US 6,488,511 B1
(45) Date of Patent: Dec. 3, 2002

(54) EXTENSION APPARATUS

(76) Inventor: Dewey H. Stewart, 117 Hennessee St., Lakeland, FL (US) 33805

( * ) Notice: Subject to any disclaimer, the term of this patent is extended or adjusted under 35 U.S.C. 154(b) by 0 days.

(21) Appl. No.: 10/056,526

(22) Filed: Jan. 25, 2002

(51) Int. Cl.[7] ..... H01R 41/00; B26B 27/00

(52) U.S. Cl. ..... 439/32; 30/296.1; 439/502; 439/575

(58) Field of Search ..... 439/32, 575, 13, 439/502, 31, 33; 30/296.1

(56) References Cited

U.S. PATENT DOCUMENTS 1,018,328 A * 2/1912 Lee et al. ..... 116/DIG. 35
1,558,211 A * 10/1925 Williams ..... 324/539
3,949,817 A 4/1976 Rice
4,207,675 A * 6/1980 Causey et al. ..... 30/296.1
4,515,423 A 5/1985 Moore et al.
4,654,971 A 4/1987 Fettes et al.
4,760,646 A 8/1988 Siegler
4,976,031 A * 12/1990 Miller ..... 30/166.3
5,261,162 A * 11/1993 Siegler ..... 30/216
5,295,620 A * 3/1994 Cousineau et al. ..... 173/170
5,333,422 A * 8/1994 Warren et al. ..... 52/115
D361,481 S 8/1995 Rees et al.
5,687,773 A * 11/1997 Ryan et al. ..... 138/109
5,826,341 A * 10/1998 Massa ..... 30/247
6,077,086 A * 6/2000 LaRoche ..... 439/173

* cited by examiner

*Primary Examiner*—Gary Paumen
*Assistant Examiner*—James R. Harvey

(57) ABSTRACT

A extension apparatus for operating electric hand tools in extended positions. The extension apparatus includes an elongate tubular member has a first end and a second end. The tubular member is telescoping and includes a bottom section, a lower middle section, an upper middle section, and a top section. Each of the sections has a first end and a second end. An electrical cord extends into the tubular member. An electrical switch is attached to the bottom section. A pair of coupling members releasably couples the bottom section, and the two middle sections. An electrical receptacle for receiving a power cord of the electrical hand tool is positioned inside the top section.

12 Claims, 3 Drawing Sheets

EXTENSION APPARATUS

BACKGROUND OF THE INVENTION

1. Field of the Invention

The present invention relates to tool extensions and more particularly pertains to a new extension apparatus for operating electric hand tools in extended positions.

2. Description of the Prior Art

The use of tool extensions is known in the prior art. U.S. Pat. No. 4,207,675 describes an adjustable utility extension handle for electrically powered hand tools. Another type of tool extensions is U.S. Pat. No. 4,760,646 having a cutting head mounted at the top of a telescoping boom.

While these devices fulfill their respective, particular objectives and requirements, the need remains for a device that has a unique, simplistic design that adapts to a wide variety of electric hand tools.

SUMMARY OF THE INVENTION

The present invention meets the needs presented above by the utilization of a telescopic handle assembly with a pivotal top section that includes a universal cavity for receiving the handles of various tools.

Still yet another object of the present invention is to provide a new extension apparatus that is lightweight and easy to handle.

Even still another object of the present invention is to provide a new extension apparatus that is easily stored in a compact space.

To this end, the present invention generally comprises an elongate tubular member has a first end and a second end. The tubular member is telescoping and includes a bottom section, a lower middle section, an upper middle section, and a top section. Each of the sections has a first end and a second end. An electrical cord extends into the tubular member. An electrical switch is attached to the bottom section. A pair of coupling members releasably couples the bottom section, and the two middle sections. An electrical receptacle for receiving a power cord of the electrical hand tool is positioned inside the top section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
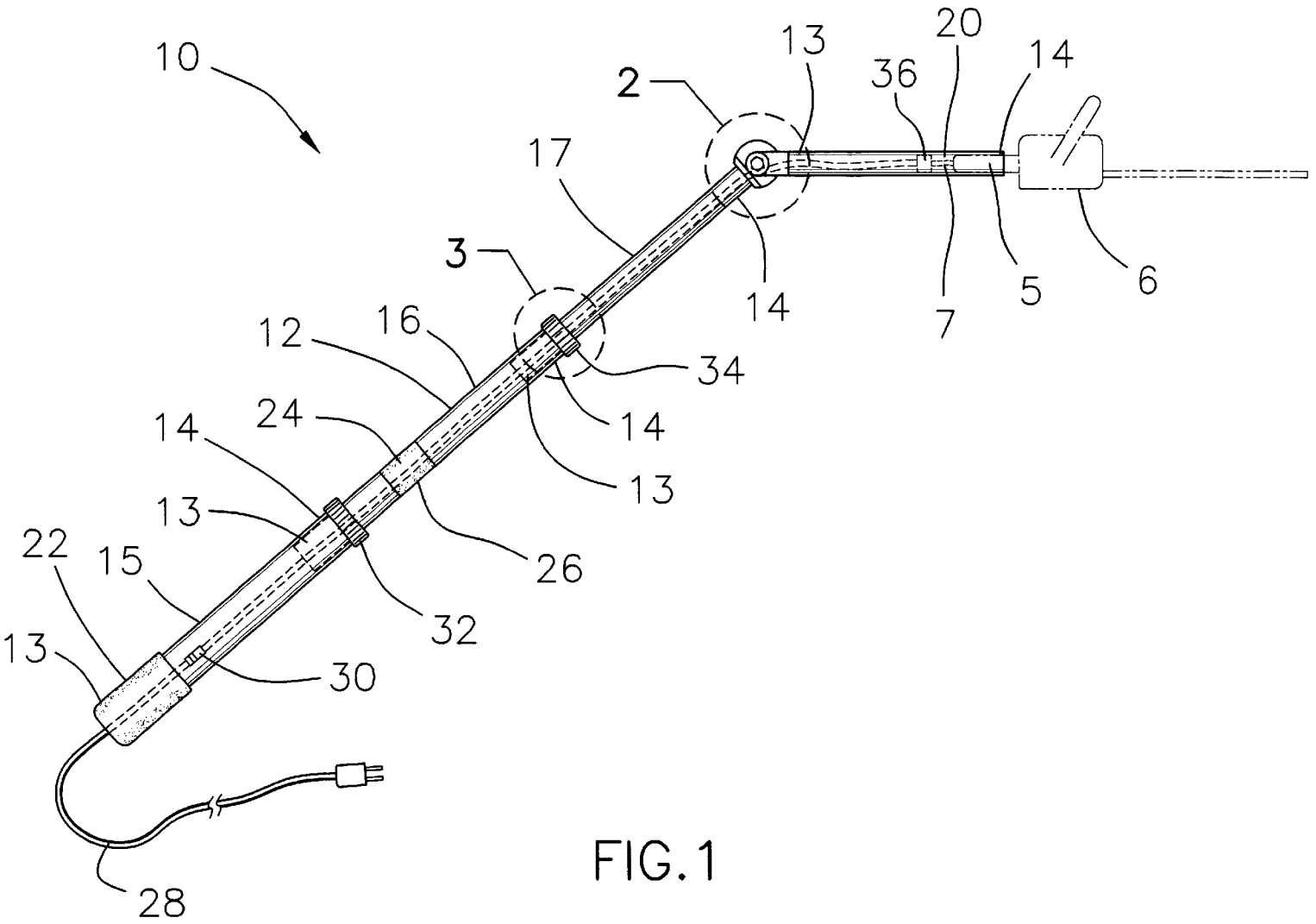
FIG. 1 is a schematic side view of a new extension apparatus according to the present invention.
Figure 2:
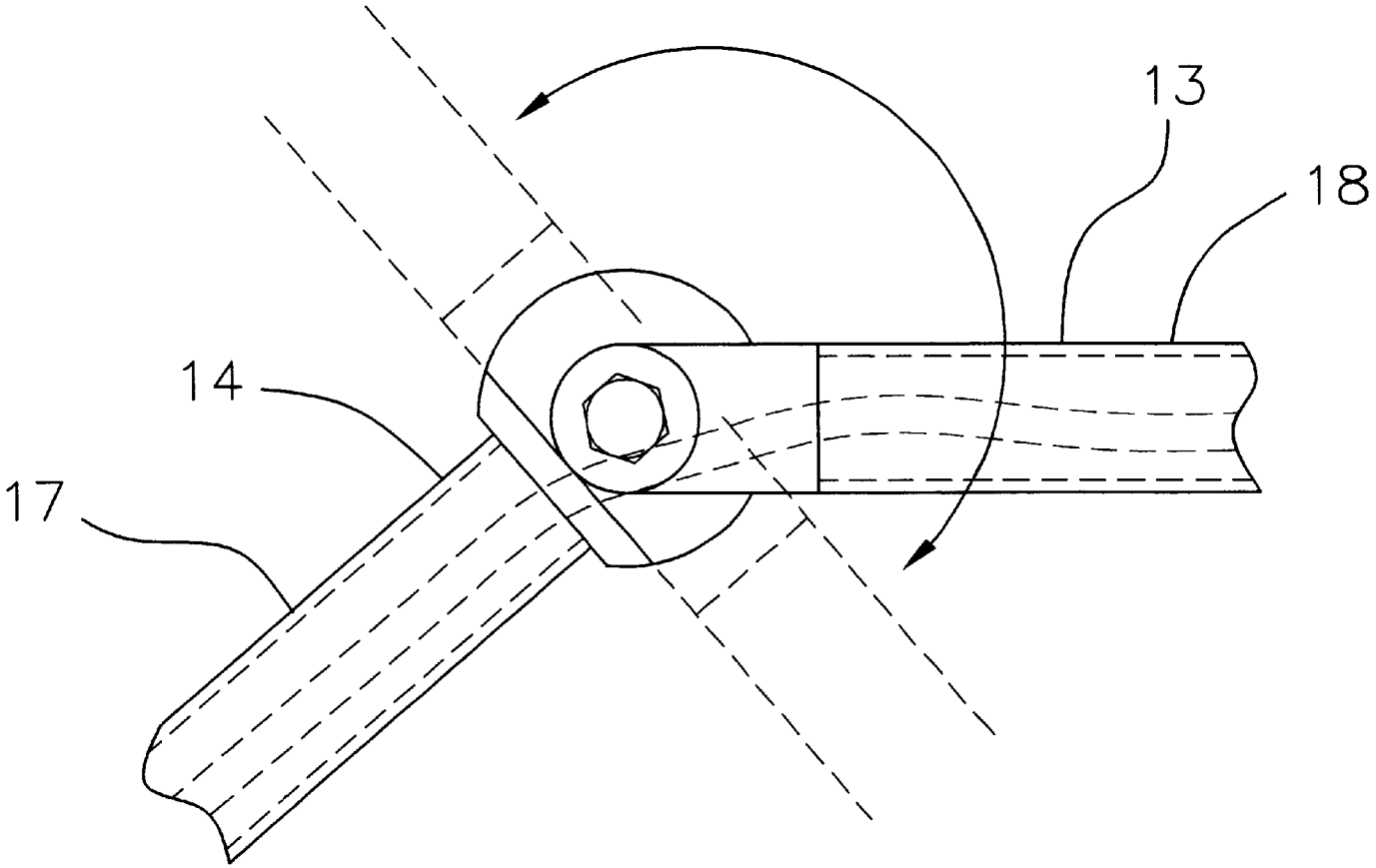
FIG. 2 is a schematic side view of the pivot point of the upper middle section and the top section of the present invention.
Figure 3:
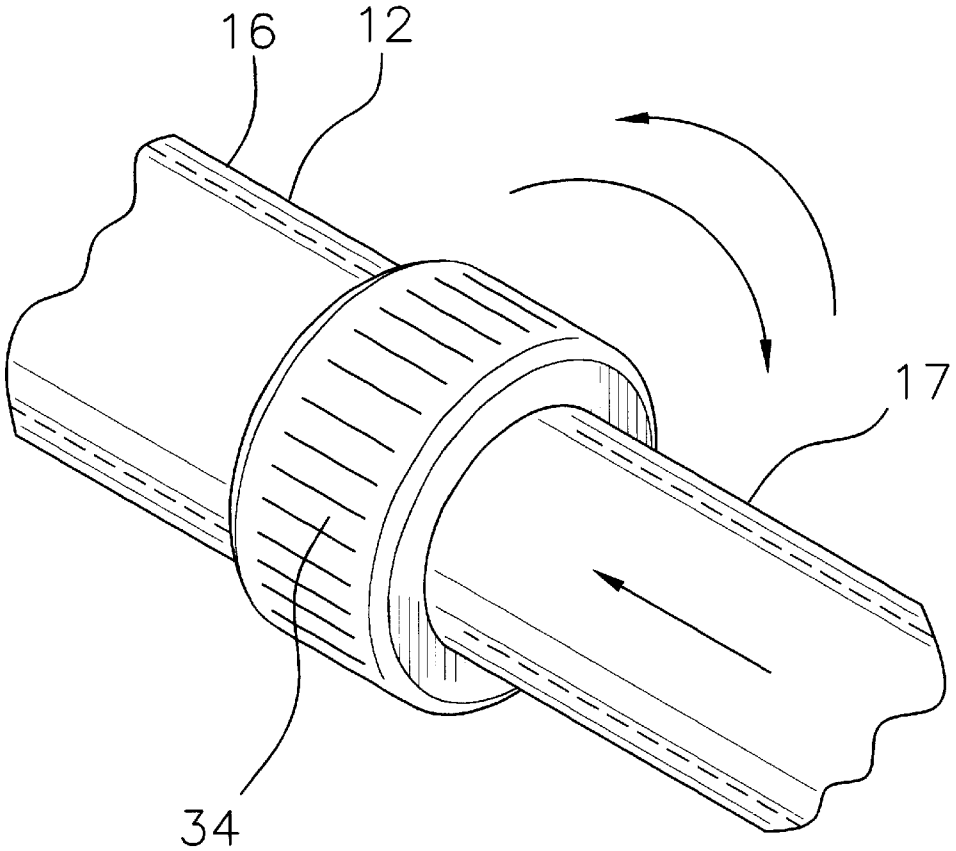
FIG. 3 is a schematic perspective view of a coupling member and the telescoping sections of the present invention.

With reference now to the drawings, and in particular to FIGS. 1 through 3 thereof, a new extension apparatus embodying the principles and concepts of the present invention and generally designated by the reference numeral 10 will be described.

As best illustrated in FIGS. 1 through 3, the extension apparatus 10 generally comprises an elongate tubular member 12 that has a first end 13 and a second end 14. The tubular member 12 is telescoping and includes a bottom section 15, a lower middle section 16, an upper middle section 17, and a top section 18. Each of the sections 15, 16, 17, 18 has a first end 13 and a second end 14.

The second end 14 of the upper middle section 17 is pivotally coupled to the first end 13 of the top section 18 such that the top section 18 is positionable at a plurality of angles with respect to a longitudinal axis of the bottom section 15 and each of the middle sections 16, 17. The second end 14 of the top section 18 includes a cavity 20 that extends therein for releasably attaching a handle 5 of the electric hand tool 6 to the tubular member 12.

A first grip member 22 for grasping onto by a hand of a user is fixedly coupled to the first end 13 of the bottom section 15. The first grip member 22 comprises a resilient elastomeric material.

A second grip member 24 for grasping onto by the hand of the user is attached to a center portion 26 of the lower middle section 16. An outer diameter of the second grip member 24 is generally equal to an outside diameter of the lower middle section 16 such that the bottom section 15 may fully telescopically receive the lower middle section 16. The second grip member 24 comprises a resilient elastomeric material.

An electrical cord 28 for connecting to a power source is fixedly coupled to the first end 13 of the bottom section 15 and extends into the tubular member 12.

An electrical switch 30 is attached to the bottom section 15 and is positioned adjacent to the first grip member 22. The switch is electrically coupled to the electrical cord 28.

A first coupling member 32 is threadably couplable to the second end 14 of the bottom section 15. An inside diameter of the second end 14 of the bottom section 15 decreases when the first coupling member 32 is threaded onto the bottom section 15 such that the lower middle section 16 is selectively couplable to the bottom section 15.

A second coupling member 34 is threadably couplable to the second end 14 of the lower middle section 16. An inside diameter of the second end 14 of the lower middle section 16 decreases when the second coupling member 34 is threaded onto the lower middle section 16 such that the upper middle section 17 is selectively couplable to the lower middle section 16.

An electrical receptacle 36 for receiving a power cord 7 of the electrical hand tool is positioned inside the top section 18. The electrical receptacle 36 is positioned adjacent to the cavity 20 of the second end 14 of the top section 18. The electrical receptacle 36 is electrically coupled to the switch.

In use, the user first plugs the tool into the receptacle in the end of the device, locks the tool's power switch into an 'on' position, then snug fits the handle into the cavity. The length of the device is adjusted as needed, along with the angle of the top section. Once plugged in to an electrical outlet, the user grabs onto the device by at the grips and activates the switch to power and utilize the tool.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extension apparatus for operating electric hand tools in extended positions, said apparatus comprising:

an elongate tubular member having a first end and a second end, said tubular member being telescoping and including a bottom section, a lower middle section, an upper middle section, and a top section, each of said sections having a first end and a second end;

a first grip member for grasping onto by a hand of a user being fixedly coupled to said first end of said bottom section;

a second grip member for grasping onto by the hand of the user being attached to a center portion of said lower middle section;

an electrical cord for connecting to a power source being fixedly coupled to said first end of said bottom section and extending into said tubular member;

an electrical switch being attached to said bottom section and being positioned adjacent to said first grip member;

a first coupling member being threadably couplable to said second end of said bottom section;

a second coupling member being threadably couplable to said second end of said lower middle section; and an electrical receptacle for receiving a power cord of the electrical hand tool being positioned inside said top section.

2. The extension apparatus as set forth in claim 1, further comprising said second end of said upper middle section being pivotally coupled to said first end of said top section such that said top section is positionable at a plurality of angles with respect to a longitudinal axis of said bottom section and each of said middle sections.

3. The extension apparatus as set forth in claim 1, further comprising said second end of said top section including a cavity extending therein for releasably attaching a handle of the electric hand tool to said tubular member.

4. The extension apparatus as set forth in claim 1, further comprising said first grip member comprising a resilient elastomeric material.

5. The extension apparatus as set forth in claim 1, further comprising an outer diameter of said second grip member being generally equal to an outside diameter of said lower middle section such that said lower middle section may be fully telescopically received by said bottom section.

6. The extension apparatus as set forth in claim 1, further comprising said second grip member comprising a resilient elastomeric material.

7. The extension apparatus as set forth in claim 1, further comprising said switch being electrically coupled to said electrical cord.

8. The extension apparatus as set forth in claim 1, further comprising an inside diameter of said second end of said bottom section decreasing when said first coupling member is threaded onto said bottom section such that said lower middle section is selectively couplable to said bottom section.

9. The extension apparatus as set forth in claim 1, further comprising an inside diameter of said second end of said lower middle section decreasing when said second coupling member is threaded onto said lower middle section such that said upper middle section is selectively couplable to said lower middle section.

10. The extension apparatus as set forth in claim 1, further comprising said electrical receptacle being positioned adjacent to said cavity of said second end of said top section.

11. The extension apparatus as set forth in claim 1, further comprising said electrical receptacle being electrically coupled to said switch.

12. An extension apparatus for operating electric hand tools in extended positions, said apparatus comprising:

an elongate tubular member having a first end and a second end, said tubular member being telescoping and including a bottom section, a lower middle section, an upper middle section, and a top section, each of said sections having a first end and a second end, said second end of said upper middle section being pivotally coupled to said first end of said top section such that said top section is positionable at a plurality of angles with respect to a longitudinal axis of said bottom section and each of said middle sections, said second end of said top section including a cavity extending therein for releasably attaching a handle of the electric hand tool to said tubular member;

a first grip member for grasping onto by a hand of a user being fixedly coupled to said first end of said bottom section, said first grip member comprising a resilient elastomeric material;

a second grip member for grasping onto by the hand of the user being attached to a center portion of said lower middle section, an outer diameter of said second grip member being generally equal to an outside diameter of said lower middle section such that said lower middle section may be fully telescopically received by said bottom section, said second grip member comprising a resilient elastomeric material;

an electrical cord for connecting to a power source being fixedly coupled to said first end of said bottom section and extending into said tubular member;

an electrical switch being attached to said bottom section and being positioned adjacent to said first grip member, said switch being electrically coupled to said electrical cord;

a first coupling member being threadably couplable to said second end of said bottom section, an inside diameter of said second end of said bottom section decreasing when said first coupling member is threaded onto said bottom section such that said lower middle section is selectively couplable to said bottom section;

a second coupling member being threadably couplable to said second end of said lower middle section, an inside diameter of said second end of said lower middle section decreasing when said second coupling member is threaded onto said lower middle section such that said upper middle section is selectively couplable to said lower middle section; and an electrical receptacle for receiving a power cord of the electrical hand tool being positioned inside said top section, said electrical receptacle being positioned adjacent to said cavity of said second end of said top section, said electrical receptacle being electrically coupled to said switch.

* * * * *